United States Patent [19]

Krieger

[11] Patent Number: 5,076,227

[45] Date of Patent: Dec. 31, 1991

[54] ARRANGEMENT FOR CONTROLLING FUEL FLOW TO AN INTERNAL-COMBUSTION ENGINE

[75] Inventor: Klaus Krieger, Affalterbach, Fed. Rep. of Germany

[73] Assignee: Robert Bosch GmbH, Stuttgart, Fed. Rep. of Germany

[21] Appl. No.: 576,384

[22] PCT Filed: Feb. 9, 1990

[86] PCT No.: PCT/DE90/00080

§ 371 Date: Sep. 18, 1990

§ 102(e) Date: Sep. 18, 1990

[87] PCT Pub. No.: WO90/12207

PCT Pub. Date: Oct. 18, 1990

[30] Foreign Application Priority Data

Apr. 8, 1989 [DE] Fed. Rep. of Germany ..... 3911559

[51] Int. Cl.[5] ..... F02B 77/00

[52] U.S. Cl. ..... 123/198 DB; 123/DIG. 2; 123/DIG. 11

[58] Field of Search ..... 123/198 DB, 510, 514, 123/DIG. 2, DIG. 11

[56] References Cited

U.S. PATENT DOCUMENTS 4,391,241 7/1983 Doshita et al. ..... 123/198 DB 4,403,580 9/1983 Bader ..... 123/198 DB

FOREIGN PATENT DOCUMENTS 2145983 3/1973 Fed. Rep. of Germany .

2312860 9/1974 Fed. Rep. of Germany .

720431 12/1954 United Kingdom .

2134987A 8/1984 United Kingdom .

*Primary Examiner*—Noah P. Kamen

*Attorney, Agent, or Firm*—Michael J. Striker

[57] ABSTRACT

An arrangement for controlling fuel flow to an internal combustion engine includes a fuel-injection pump, a fuel tank, and a mechanically driven pre-supply pump for supplying fuel from the fuel tank to the suction space of the fuel injection pump. An electromagnetic control valve located downstream of the pre-supply pump and upstream of the suction space of the fuel injection pump moves between a supply position in which fuel flows from the pre-supply pump into the suction space, and a disconnect position. A mechanically driven additional suction supply pump communicates the suction space with the fuel tank in the disconnect position of the electromagnetic control valve. The electromagnetic control valve has throttle means for communicating the suction space of the fuel injection pump with the inlet of the additional suction supply pump in the disconnect position of the electromagnetic control valve.

5 Claims, 2 Drawing Sheets

ARRANGEMENT FOR CONTROLLING FUEL FLOW TO AN INTERNAL-COMBUSTION ENGINE

BACKGROUND OF THE INVENTION

The invention relates to an arrangement for controlling fuel flow to an internal-combustion engine, especially a diesel internal-combustion engine, and comprising a fuel-injection pump, a mechanically driven pre-supply pump for supplying fuel from a fuel tank to the suction space of the fuel injection pump, an electromagnetic control valve located downstream of the pre-supply pump and upstream of the suction space and movable between a supply position in which fuel flows from the pre-supply pump into the suction space, and a disconnected position, and an additional suction supply pump for communicating the suction space with the fuel tank in the disconnected position of the control valve.

German Offenlegungsschrift 3,304,355 discloses a control arrangement of the particular generic type, in which, in an alternative solution according to the embodiment FIG. 2, an electrically driven supply pump with a pole-changing electric motor and reversible feed device is used to stop the internal-combustion engine. Upon cutoff of the internal-combustion engine, the suction space of the fuel-injection pump is connected to the suction side of the supply pump, and the delivery side of the supply pump is connected to the fuel tank.

In the event of a cutoff, fuel is thereby extracted abruptly from the suction space of the fuel-injection pump, so that the fuel-injection pump can no longer deliver fuel, and the associated internal-combustion engine stops.

It has been shown that, in this known control arrangement, the suction effect of the supply pump of bipolar design in the flow part, that is to say working in both directions of rotation and therefore fundamentally not optionally adjustable, is not always sufficient to generate a high enough vacuum in the suction space of the injection pump as quickly and as abruptly as possible. This does not ensure a satisfactory cutoff of the internal-combustion engine, and consequently the danger of engine damage as a result of overspeeding an excess quantity of fuel and of accidents, is not prevented sufficiently reliably because "gas cutoff" is not possible.

A further disadvantage of this solution is that peripheral suction and delivery lines of the supply pump working in two supply directions have to be uncoupled hydraulically, this necessitating additional components, for example additional non-return valves. This involves a high outlay in terms of constructional space and cost and constitutes an undesirable safety risk in that. If one of these additional components functions inadequately or even fails, the entire system can break down. Moreover, the total outlay for the use of reversible electric fuel pumps on diesel engines is considerable because of the additional current supply and the control circuit required.

In a further alternative solution (according to the embodiment of FIG. 1 of German Offenlegungsschrift 3,304,355), in addition to a supply pump serving only for delivering to the suction space of the fuel-injection pump, there is provided a second electrically driven supply pump which comes into operation only in the event of the cutoff of the internal-combustion engine. It is activated and operated electrically via an electronic control unit which interacts with an electrohydraulic injection-pump controller. This system involves a high outlay and is cost-intensive and with the degree of complexity and mutual dependence increases the risk of failure.

SUMMARY OF THE INVENTION

The object of the invention is a control arrangement guarantees a sufficiently rapid emergency cutoff of the internal-combustion engine, especially diesel internal-combustion engine. The object of the invention is achieved by providing a control device in which the additional supply means is a mechanically driven pump, the electromagnetic control valve has throttle means for communicating the suction space with the inlet of the additional suction supply pump in the disconnected position of the electromagnetic control valve. The mechanically and therefore permanently driven suction supply pump, intended only for suction from the suction space of the fuel-injection pump, ensures that the suction space of the fuel-injection pump empty as quickly as possible in the event of a cutoff of the internal-combustion engine. Since the pre-supply pump which, when the internal-combustion engine is operating, supplies the suction space of the internal-combustion engine with fuel is also mechanically driven, there is no need for a control unit activating the two supply pumps and the two supply pumps can be driven without difficulty via the camshaft already present in any case on the same side as the injection pump.

Furthermore, only a simple two-position directional valve is required for the respective activation of the two supply pumps necessary in normal operation and in the event of a cutoff. There is therefore used a control device that needs only a few components which are of simple, cost-effective and functionally reliable design.

A control valve having a valve housing mounted directly at the suction space inlet of the fuel-injection pump and in which there is located a valve member of a cylindrical basic form, can also be integrated into the controller cover of the fuel-injection pump in a simple, dirt-proof, compact and therefore advantageous way.

Moreover, further simplifications in the designs of the supply pumps is achieved by designing them as identical piston pumps especially as a double supply pump having a common housing and/or a common drive from the existing camshaft of the fuel-injection pump.

Using a restoring spring for biasing the control valve member of the control valve into a fuel supply position permits to eliminate need in current supply to the control valve so that, because of use of mechanically driven supply pumps, no current consumption takes place during normal operation.

On the other hand, by using electrically actuated means for moving the valve member to its supply position against the spring force applied by the restoring spring in another embodiment of the fuel flow control arrangement, an automatic cut-off of the internal combustion engine, in case of interception of current supply, is insured.

The present invention both as to its construction so to its method of operation, together with additional objects and advantages thereof, will be best understood from the following detailed description of the preferred embodiments when read with reference to the accompanying drawings.

BRIEF DESCRIPTION OF THE DRAWINGS

Two exemplary embodiments are illustrated in the drawing and explained in more detail below.

DESCRIPTION OF THE PREFERRED EMBODIMENTS

Figure 1:
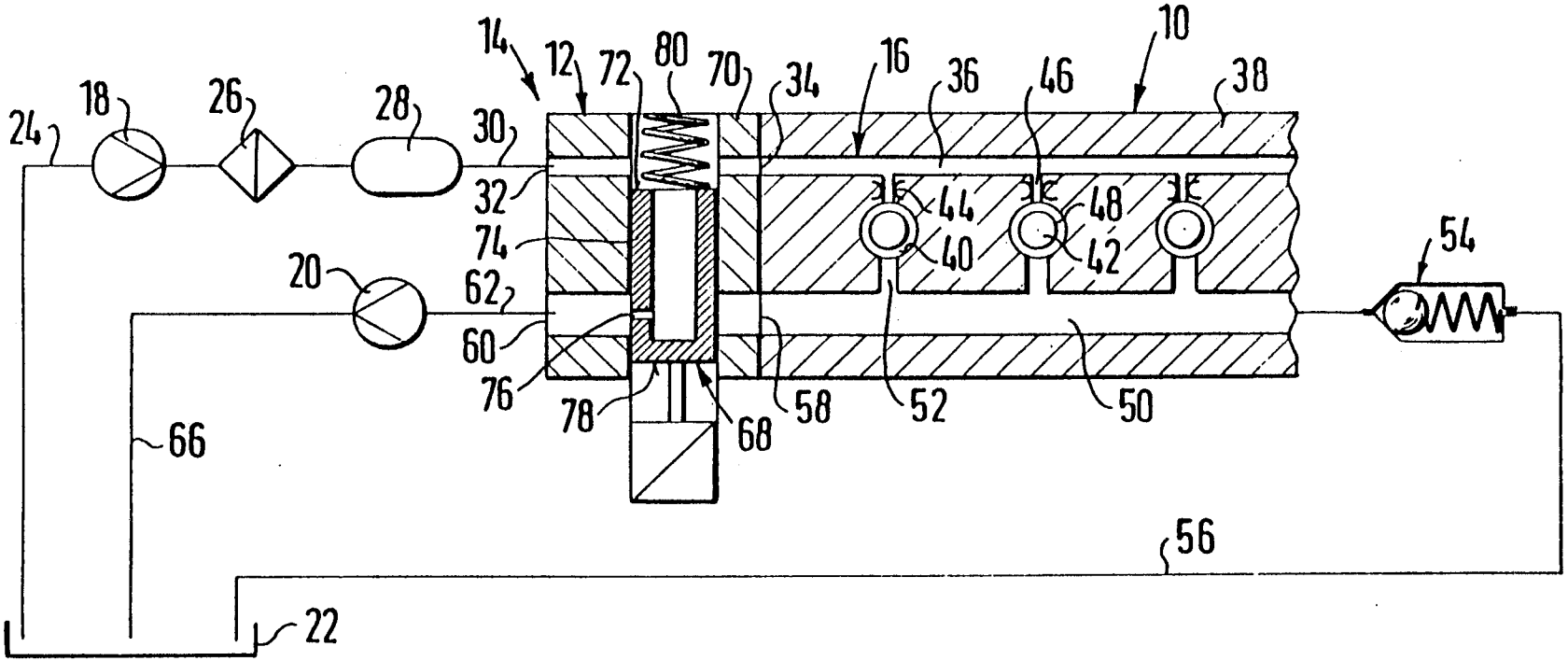
FIG. 1 shows a partial cross-sectional view of a first embodiment of a fuel-injection pump according to the invention, with a transversely flushed suction space.
Figure 2:
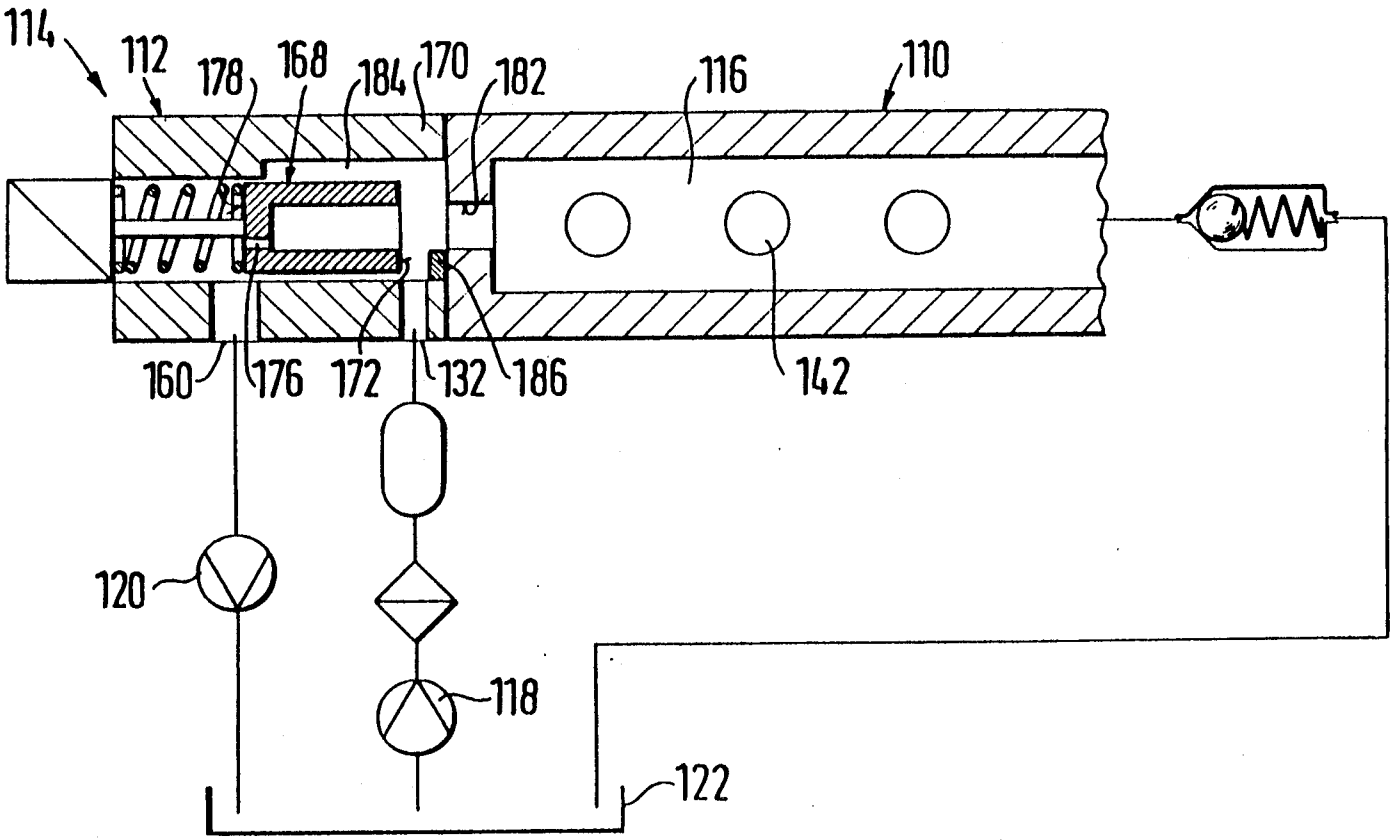
FIG. 2 shows a partial cross-sectional view of a second embodiment of a fuel-injection pump according to the invention, with a normally flushed suction space.

In FIGS. 1 and 2, a fuel-injection pump 10 for diesel internal-combustion engines which is designed as a multi-cylinder in-line injection pump is shown with a built-on control valve 12 as part of a control device 14. The basic arrangement of the elements of such a fuel-injection pump 10 is known per se, the design of the fuel-injection pump 10 with a transversely flushed suction space 16 present in the first embodiment, as shown in FIG. 1, being described in detail by way of example in German Offenlegungsschrift 3,326,045. The control device 14, consisting essentially of the control valve 12, pre-supply pump 18 and a suction supply pump 20, supplies fuel to the fuel-injection pump 10 during a supply position. In contrast, during a disconnected position of the control device 14, fuel is evacuated from the fuel-injection pump 10. The mechanically driven pre-supply pumps 18 is a piston supply pump known per se, which is equipped with a suction and a delivery valve and which is mounted on the fuel-injection pump 10, in practice at camshaft level. The pre-supply forepump 18 is connected on its suction side to a suction line 24 connected to a tank 22. Downstream of the pre-supply 18, there is connected to its delivery side a supply line 30 which receives a fuel filter 26 and a fuel storage 28 and which opens into a first connection 32 of the control valve 12.

In the first embodiment according to FIG. 1, there corresponds to the first connection 32 a second connection 34, to which an inlet channel 36 of the fuel-injection pump 10 is connected. From this branch off inlet ports 46 which are each equipped with a throttle 44 according to the number of receiving bores 40 arranged in series in a housing 38 of the fuel-injection pump 10 and intended for the pump cylinders 42 and which open into part suction spaces 48 designed as annular grooves and themselves each having, on the other side, a return-flow ports 52 connected to a return channel 50.

Each return port 52 has a throughflow cross-section substantially smaller than the cross-section of the return channel 50, and the throughflow cross-section of each throttle 44 in the inlet ports 46 is smaller than the throughflow cross-section of the associated return port 52. Connected to the return channel 50 is an overflow line 56 having a pressure-holding valve 54 and opening into the tank 22. That end of the return channel 50 facing away from the overflow line 56 is connected to a third connection 58 of the control valve 12. There corresponds to the third connection 58 a fourth connection 60 which serves as a supply connection and to which is connected via a suction line 62 the suction supply pump 20 connected downstream to the tank 22 via a tank return line 66. The control valve 12 is designed as a solenoid valve and has a valve member 68 located in a hollow cylindrical a valve housing 70 and sealingly displaceable in the axial direction between a supply position and a disconnected position. The valve member 68 forms, on one hand, an incompletely closed end face 72 confronting the first connection 32 and the second connection 34 and, on the other hand, a completely closed second end face 78 which is located opposite the first end face 72 and interacts with the third connection 58 and the fourth connection 60 and which carries a hollow cylindrical wall 74 having, in the region of the fourth connection 60, a throttle channel 76 formed by a narrow bore. As shown in FIG. 1, a restoring spring 80 engaging the first end face 72 and supported in the valve housing 70 keeps, the valve member 68 in the supply position.

The illustrated arrangement described affords the following functional and operating sequence. Starting from the feed position of the control valve 12, its control member 68 is brought by the force of the restoring spring 80 to the end position, in which there is hydraulic communication between the first connection 32 and the second connection 34, and the third connection 58 is separated hydraulically from the fourth connection 60 by the intermediate valve member 68. In this operating position, the fuel supplied by the pre-supply pump 18 passes, according to the position of the control edge of the first end face 72, via the first connection 32 and the second connection 34 to the inlet channel 36, from which the fuel flows to the part suction spaces 48 of the pump cylinders 42 via the throttles 44 and the inlet ports 46. Excess fuel can flow off to the tank 22 via the return ports 52, the return channel 50 and the pressure valve 54. On the other hand, the fuel supplied by the pre-supply 18 passes via the first connection 32, the pierced first end face 72 to the throttle channel 76, through this to the fourth connection 60, and from here further via the suction line 62, the suction supply pump 20, and the tank return line 66 back to the tank 22. This fuel flow is restricted by the flow cross-section of the throttle channel 76 in such a way that, on one hand, there is a minimum throughflow for the self-lubrication of the mechanical permanently driven suction supply pump 20 and, on the other hand, the filling of the pump cylinders 42 taking place in the main flow is not yet weakened so as to impair functioning.

To stop the internal-combustion engine in the event of an emergency cutoff, the fuel required for injection is evacuated from the internal-combustion engine, on the one hand by supplying no more fuel to the suction space 16 of the associated fuel-injection pump 10 and, on the other hand, by suction of the fuel located in the suction space 16 of the fuel-injection pump 10. For this purpose, by means of magnetically excited actuating forces of the control valve 12, the valve member 68 is brought, counter to the force of the restoring spring 80, into the other end position, in which communication between the first connection 32 and the second connection 34 is shut off by the control edge of the first end face 72, and by the position of the control edge of the second end face 78 the third connection 58 is connected hydraulically to the fourth connection 60.

Consequently, the fuel supplied by the pre-supply pump 18 passes neither to the part suction spaces 48 nor via the throttle channel 76 to the fourth connection 60, since the throttle channel 76 has been shifted out of the catchment region of the fourth connection 60 as a result of the axial displacement of the control member 68 into the other end position. Nevertheless, the suction supply pump 20 receives the fuel from the suction space 60 of the fuel-injection pump and, during the emptying of the suction space 16, conveys this fuel back via the tank 22. There is no danger that the pre-supply pump 18 will be overloaded nor that the suction supply pump 20 will run dry because the fuel injection pump 10 comes to a stop and the drive of the pre-supply pump 18 and the suction supply pump 20 is cancelled.

As shown in FIG. 1, the control valve 12 does not have to be a separate constructional unit, but can form a constructional combination with the fuel-injection pump 10, in that the second connection 34 coincides with the inlet channel 36, and the third connection 58 with the return channel 50, as a result of these two fixed connections the number of free connections being reduced to the minimum requirement of two, for the connection of the feed forepump 18 and for that of the suction feed pump 20, and consequently an improved operating reliability being achieved. Furthermore, it is possible to form the throttle channel 76 by a shallow annular groove made in the same region in the outer surface of the valve member 68, so that, in the supply position, the fuel required for the self-lubrication of the suction supply pump 20 can flow in from the return channel 50.

In a modified mode, the operation of the control valve 12 can also be such that, in the supply position, the control valve 12 receives operating voltage, and the control member 68 is held counter to the force of the restoring spring 80, whilst when operating voltage is absent, the restoring spring 80 brings the valve member 68 into the disconnected position.

In a second embodiment of the control device 114 according to FIG. 2, the fuel-injection pump 110 is shown with a suction space 116 common to all the pump cylinders 142 and also receiving the cutoff fuel quantity, reference symbols greater by 100 being used for parts corresponding to the parts of the first embodiment, so that reference is thereby made to the description of the first embodiment in order to avoid repetition.

In the second embodiment, in which the direction of movement of the valve member 168 extends longitudinally relative to the pump cylinders 142 arranged in series and is consequently rotated through 90 degrees relative to the direction of movement of the valve member 168, the second connection 34, the inlet channel 36, the throttle 44, the part suction spaces 48, the return channel 50, the return ports 52 and the third connection 58 are omitted. Instead, the suction space 116 possesses, at the mounting point of the control valve 112, a central perforation 182 which allows the exchange of fuel through the built-on valve housing 170 likewise made open in this region. The valve housing 170, likewise of a hollow-cylindrical basic inner form, has in the region of the valve member 168 a longitudinal groove 184 which is so designed and positioned so that, in the supply position of the control valve 112, fuel does pass from the pre-supply pump 118 to the suction space 116, but not, however, via the longitudinal groove 184 to the fourth connection 160. The fourth connection 160 itself receives fuel in a bypass flow via the throttle channel 176 which, in this second embodiment, is inserted in the second end face 178.

In contrast to the operating sequence, the functional sequence of the second embodiment differs from that of the first embodiment in that, to obtain the supply position shown in FIG. 2, the force of the restoring spring 180 has to be overcome by the magnetically excited actuating forces of the control valve 112. In this supply position, the suction space 116 of the fuel-injection pump 110 is supplied with fuel by the pre-supply pump 118 via the first connection 132, kept open by the position of the control edge formed by the first end face 172, and the perforation 182.

To stop the internal-combustion engine, the current flow to the control valve 112 is interrupted, and as a result of the actuating force of the restoring spring 180, the control member 168 assumes the other end position which represents the disconnected position and which is adopted when the first end face 172 runs up against a stop 186, with the result that, on one hand, the first connection 132 is closed by the control edge of the first end face 172 and, on the other hand, communication from the fourth connection 160 to the longitudinal groove 184 is opened by the control edge of the second end face 178. Since, by means of the stop 186, the hydraulic connection between the longitudinal groove 184 and the suction space 116 is not closed, even in the disconnected position of the control valve 112, the suction supply pump 120 can be connected hydraulically to the suction space 116 and consequently effect withdrawal of fuel from the suction space 116 into the tank 122.

In the modified of the second embodiment, the valve member 168 of the control valve 112 can also be held in the supply position, shown in FIG. 2, by the restoring spring 180 and be brought into the disconnected position by a magnetically excited actuating force of the control valve 112.

The above-described control device 14; 114 according to FIG. 1 and FIG. 2 guarantees a reliable and sufficiently rapid stopping of the internal-combustion engine with simply designed parts which can be produced cost-effectively. Possible engine damage as a result of overspeeding an excess quantity of fuel, and accidents because a "gas cutoff" is reliably prevented by the use of a control valve 12; 112 of uncomplicated design and two mechanically driven supply pumps 18; 20 or 118; 120, which can be combined in a common pump housing and also be equipped with a common drive.

While the invention has been illustrated and described as embodied in a control device for stopping an internal combustion engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement for controlling fuel flow to an internal combustion engine, said arrangement comprising a fuel-injection pump having a suction space; a fuel tank; a mechanically driven pre-supply pump for supplying fuel from said fuel tank to said suction space; an electromagnetic control valve located downstream of said pre-supply pump and upstream of said suction space and movable between a supply position in which fuel flows from said pre-supply pump into said suction space, and a disconnect position; and a mechanically driven additional suction supply pump for communicating said suction space with said fuel tank in the disconnected position of said electromagnetic control valve, and having an inlet, said electromagnetic control valve having throttle means for communicating said suction space with said inlet of said additional suction supply pump in the disconnect position of said electromagnetic control valve.

2. An arrangement as set forth in claim 1, wherein said suction space has an inlet, said electromagnetic control valve being formed as a 4/2-way directional control valve and being mounted directly at said inlet of said suction space.

3. An arrangement as set forth in claim 1, wherein said electromagnetic control valve comprises a housing, and a cylindrical valve member displaceable in said housing and having opposite end faces defining control edges.

4. An arrangement as set forth in claim 3, wherein said electromagnetic control valve further comprises spring means for biasing said valve member to the supply position thereof, and electrically actuated means for moving said valve member to the disconnect position thereof against a spring force applied by said spring means.

5. An arrangement as set forth in claim 3, wherein said electromagnetic control valve further comprises spring means for biasing said valve member to the disconnect position thereof, and electrically actuated means for moving said valve member to the supply position thereof against a spring force applied by said spring means.

* * * * *